United States Patent [19]

Tauber et al.

[11] Patent Number: 4,788,928

[45] Date of Patent: Dec. 6, 1988

[54] PNEUMATIC PLUNGER SYSTEM

[76] Inventors: David Tauber; William Philippson, both of 2386 Grant Avenue, Courtenay, B.C., Canada, V6N 7M3

[21] Appl. No.: 74,361

[22] Filed: Jul. 16, 1987

[51] Int. Cl.[4] ..... B63B 35/14

[52] U.S. Cl. ..... 114/255; 114/67 A; 43/4.5; 43/7

[58] Field of Search ..... 114/255, 67 A; 43/4.5, 43/4, 1, 7, 6.5, 14

[56] References Cited

U.S. PATENT DOCUMENTS

| | | | |
|---|---|---|---|
| 2,364,845 | 12/1944 | Glen | 114/67 A X |
| 3,309,807 | 3/1967 | Wells | 43/4.5 X |
| 3,907,061 | 9/1975 | Chapman et al. | 114/67 A X |
| 4,135,469 | 1/1979 | Rimppi et al. | 114/67 A |

FOREIGN PATENT DOCUMENTS

| | | | |
|---|---|---|---|
| 0164294 | 9/1984 | Japan | 114/67 A |

OTHER PUBLICATIONS

"National Geographic", vol. 125, No. 6, p. 796.

*Primary Examiner*—Sherman D. Basinger
*Attorney, Agent, or Firm*—Pascal & Associates

[57] ABSTRACT

A pneumatic plunger system for use in a commercial seine fishing vessel, comprising apparatus for expelling a mixture of forced air and water through a plurality of nozzles that are located along the keel of the vessel. The forced air and water which is ejected through the nozzles creates a wall of air bubbles extending substantially vertically and downward from the keel. Fish swimming between the net and the wall of air bubbles are startled by the air bubbles and are repelled into the net.

12 Claims, 3 Drawing Sheets

PNEUMATIC PLUNGER SYSTEM

Figure 1:
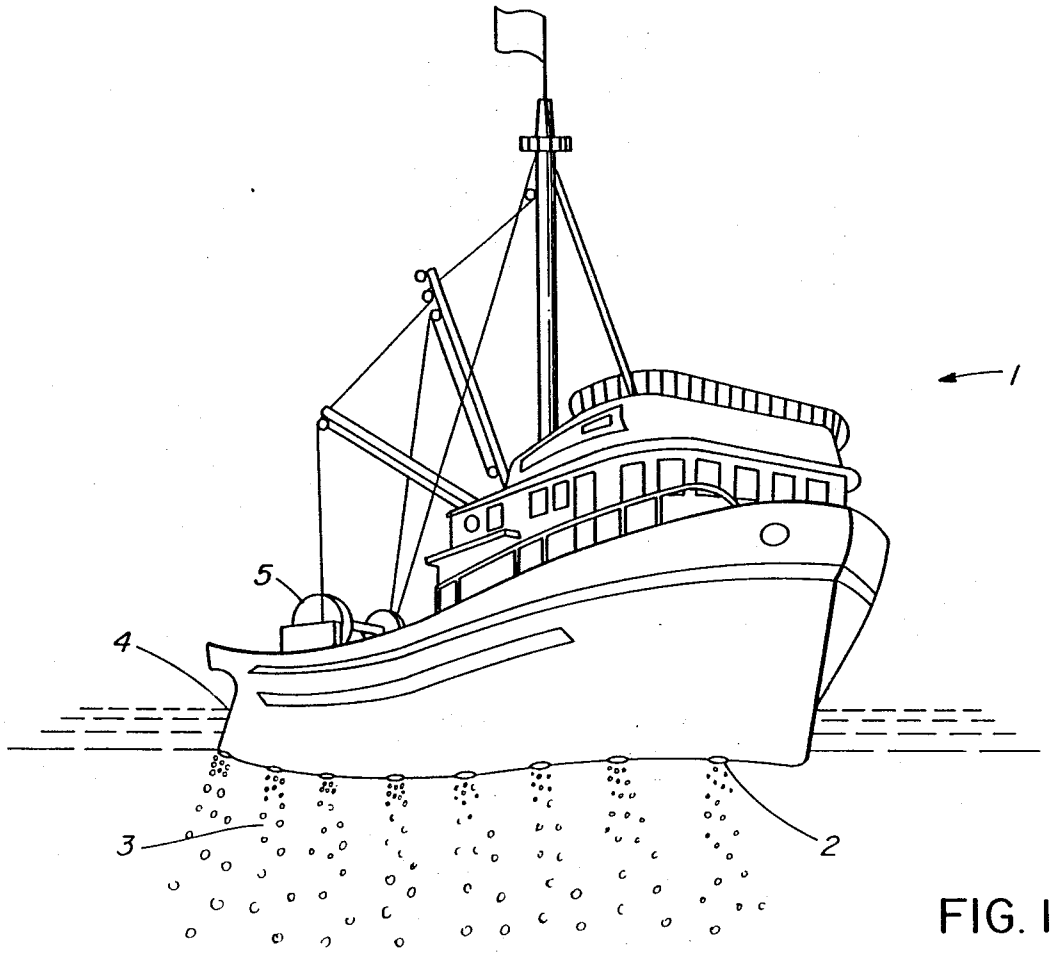

The invention relates in general to commercial fishing vessels, and more particularly to a pneumatic plunger system for use in a seine fishing vessel.

According to well known seine fishing methods, a net is cast overboard into surrounding water in the form of a large loop The net is drawn in by means of a deck drum located at the stern of the vessel. The lowermost portion of the net is bounded by a purse line which is simultaneously drawn in by means of a winch located mid-ship. As the net and purse line are drawn in, the loop formed by the net becomes smaller.

It has been found that as the loop becomes smaller, fish swimming in the vicinity of the net and the vessel have a tendency to escape through the circular opening defined by the purse line. This typically results in a significant decrease in the size of the catch.

In an effort to deter fish from escaping from the aforementioned hole, fishermen have been known to use a pole approximately 15 feet in length having a plunger head at one end thereof. The pole is dipped into surrounding water along the side of the fishing vessel and the plunger is manually actuated to cause a small stream of air bubbles to be expelled toward the fish in an effort to scare the fish and thereby repel them into the belly of the net.

This prior art technique has been found to be inefficient since only a small stream of bubbles is produced. Furthermore, this technique requires considerable manual effort to implement.

According to the present invention, a pneumatic plunger system is provided comprised of a plurality of nozzles evenly spaced along the keel of a boat, or fishing vessel. Compressed air is forced through the nozzles in order to create a wall of air bubbles extending the length of the boat and to a predetermined depth controlled by the compressed air pressure. The wall of air bubbles scares and thereby repels the fish toward the belly Of the net as it is being drawn in, rather than permitting the fish to escape under the bottom of the boat.

Systems are known for using compressed air in boats. For example, U.S. Pat. No. 4,074,651 (Arduser) teaches a system using a water pipe having an intake position below the water line, and a discharge spray bar for delivering aerated water to a well which is disposed within the hull of the boat. Similarly, U.S. Pat. No. 4,340,004 (Kanei) teaches the use of compressed air for filling an air holding space within a displacement type hull of a ship for providing increased buoyancy, and thereby reducing the wave making drag of the bow of the ship so that the ship can move easily and reliably at high speed.

U.S. Pat. Nos. 4,546,719 (Collins, et al) and 2,754,791 (Nieding relate to systems for expelling air bubbles from the hull of a boat into the surrounding water in Order to aerate the water adjacent to the bow and thereby reduce resistance to forward motion of the ship through the water.

Such prior art bubbling systems are used mainly to enhance manoeuvering of the vessel in severe ice conditions by developing a small cushion of air to keep ice from contacting the hull.

By way of contrast with the above-mentioned prior art, according to the present invention a system is provided for generating a substantially vertical wall of air bubbles from the keel of a fishing boat in order to repel fish into the belly of a net attached to the boat.

Figure 2:
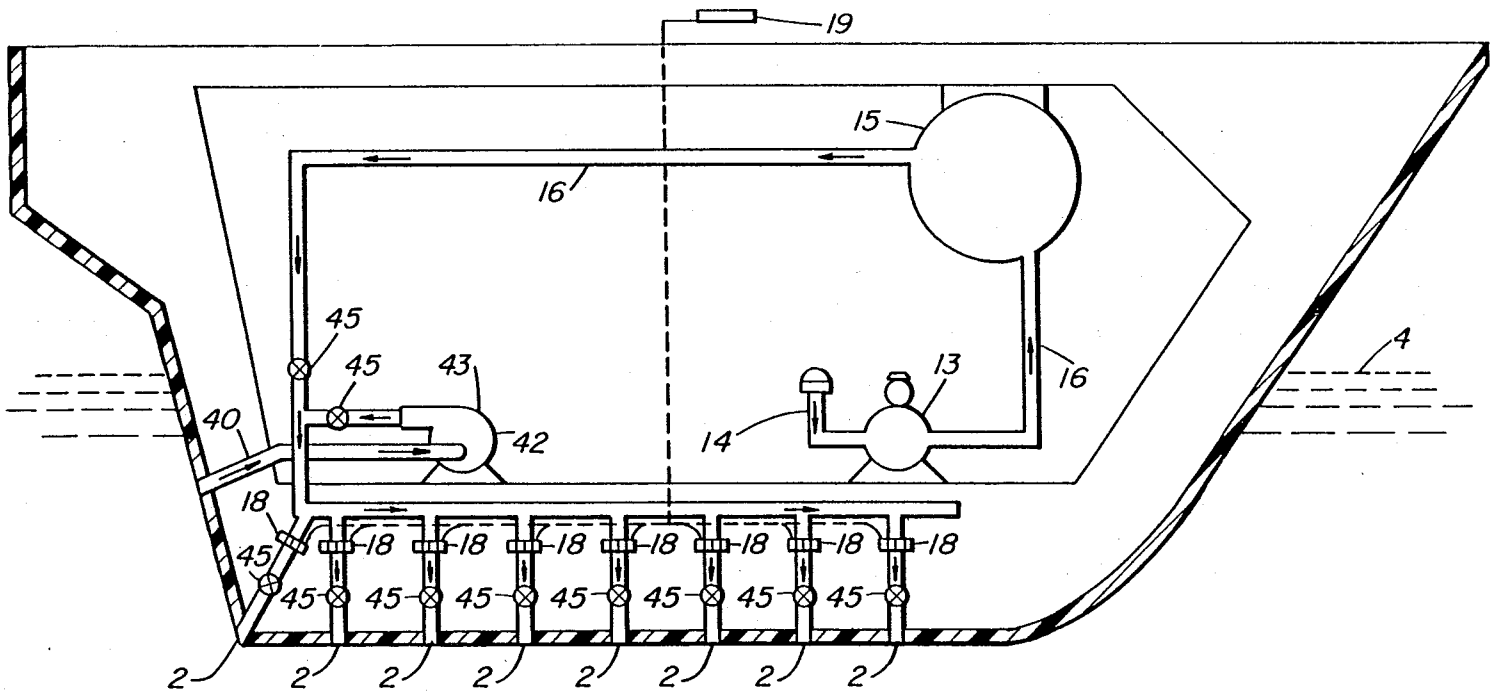
Figure 3:
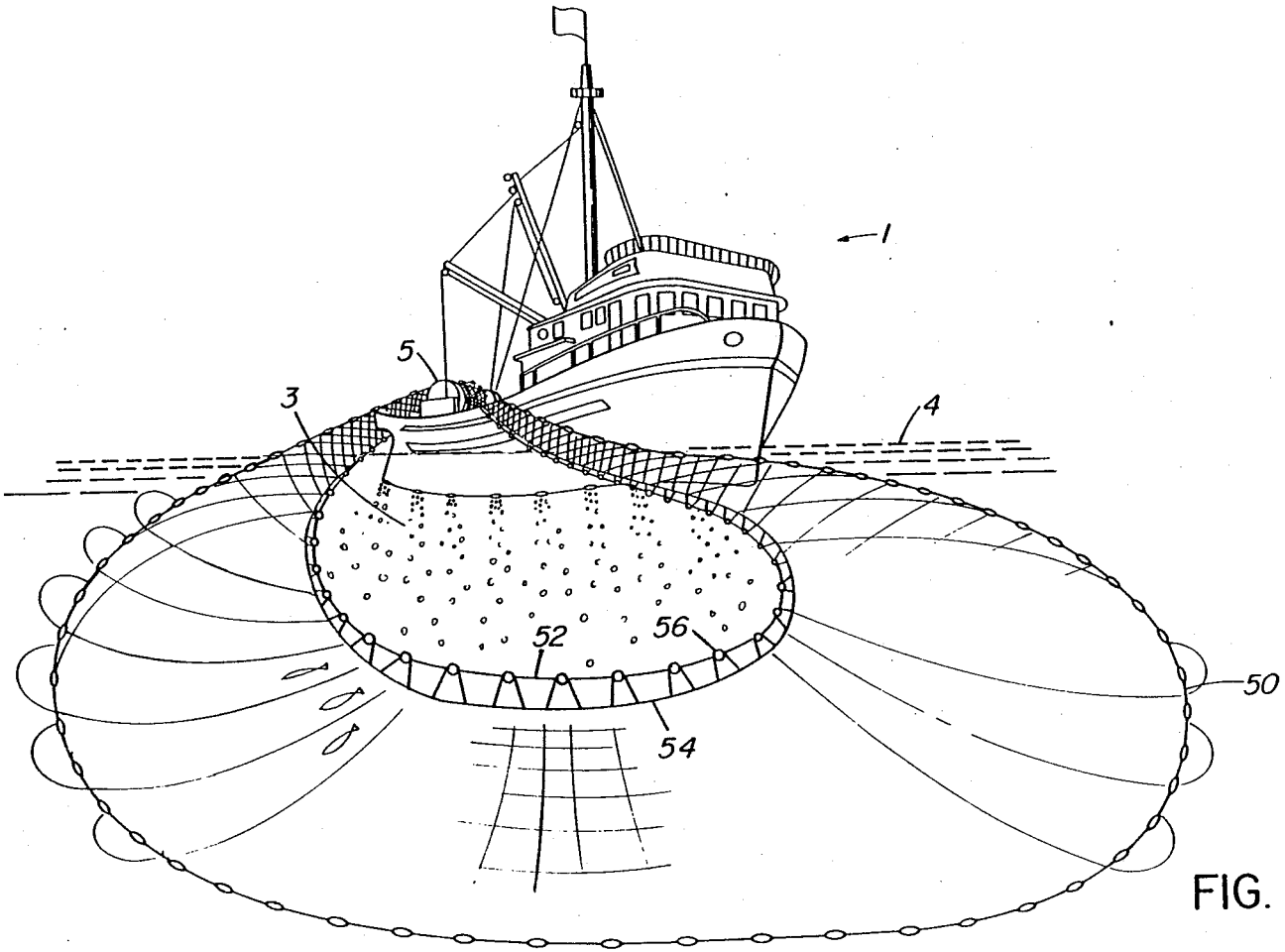

A better understanding of the present invention will be obtained with reference to the detailed description below in conjunction with the following drawings in which:

FIG. 1 is a perspective view of a commercial seine fishing vessel equipped with a pneumatic plunger system in accordance with the present invention, FIG. 2 is a schematic view of the pneumatic plunger system according to a preferred embodiment of the present invention, and FIG. 3 is a perspective view of a commercial seine fishing vessel with seine net being pursed up, and a wall of air bubbles extending from the keel of the vessel, in accordance with the present invention.

With reference to FIG. 1, a commercial seine fishing vessel 1 is shown equipped with a deck drum 5 for hauling in a fishing net, and a plurality of air nozzles 2 disposed along the keel of the vessel for expelling a mixture of compressed air and water which forms a wall of air bubbles 3 below the water line 4.

With reference to FIG. 2, a preferred embodiment of the pneumatic plunger system is shown disposed within the hull of a seine fishing vessel. An air compressor 13 is connected to a suction inlet 14 for receiving and forcing air into a receiving tank 15 by means of an exhaust line 16. The air compressor 13 pressurizes the air within the receiving tank 15 to a predetermined desired pressure. An indication of the pressure within the receiving tank is provided to an operator on deck (not shown).

Exhaust line 16 extends from the receiving tank 15 to the aforementioned plurality of nozzles 2 disposed along the keel of the vessel. A plurality of solenoids 18 are connected to respective ones of the nozzles 2 and are actuated by means of a remote control 19 situated on deck.

Water is drawn in through an inlet 40 located in the hull of the vessel below the water line 4, by means of a water pump 42. Water pump 42 is connected by means of a water pipe 43 to the exhaust line 16.

A plurality of unidirectional check valves 45 are disposed in the exhaust line 16, water pipe 43, and are connected to respective ones of the nozzles 2.

Once the predetermined desired air pressure is reached within the receiving tank 15, the operator selectively actuates one or more of the solenoids 18 for expelling the high pressure air from the nozzles 2.

In particular, air flows from the receiving tank 15 via the exhaust line 16 through respective ones of the enabled solenoids 18 to the respective nozzles. Water is pumped through water pipe 43 by means of pump 42 and mixed with the high pressure air flow within the exhaust line 16.

It has been found that by positioning the nozzles 2 along the keel of the vessel, and mixing an appropriate amount of water with the high pressure air flow, a substantially vertical wall of bubbles 3 (FIG. 1) is created beneath the keel of the vessel.

As a result of mixing water with the high pressure air flow, the air bubbles are expelled to a greater depth below the fishing vessel than is possible with any of the prior art compressed air bubbling systems discussed herein above.

By selectively enabling all or predetermined ones of the solenoids 18, the shape of the wall of bubbles can be controlled by the operator on deck.

With reference to FIG. 3, the seine vessel 1 is shown with its net overboard and being drawn in. The net is shown in a closed position and is bounded by a cork line 50 supporting one end of the net meshing, and a purse line 52 and led line 54 submerged below the water line 4. The purse line 52 is fed through purse rings 56 connected to the led line 54, and the led line 54 is attached to the meshing of the net which in turn is connected to the cork line 50.

Once the net is in a closed position (as shown), it is drummed in by means of spooling onto the deck drum 5 situated at the stern of the ship, the opposite end of the net being secured approximately mid-ship.

As the net is being drummed in, the purse line 52 is simultaneously pulled in by means of a purse winch located mid-ship. The purse line 52 forms a circular hole of diminishing diameter, through which the fish have a tendency to escape under the vessel 1, as discussed above.

However, according to the present invention, an operator can activate the solenoids 18 (FIG. 2) by means of the remote control 19 for creating a wall of air bubbles 3 which repels the fish back into the belly of the net, resulting in higher yield in catch and greater efficiency of fishing operations.

The present invention provides a solution to a long-standing problem in the seine fishing industry whereby fish escape through the circular hole bounded by the purse line while the net is being drummed in.

The system of the present invention is substantially more efficient than the known prior art method of manual bubble generation, and provides for generation of a substantially vertical wall of air bubbles, which is extremely effective for repelling fish, in contrast with prior art compressed air bubbling systems.

A person understanding the present invention may conceive of other embodiments or variations therein. For example, the predetermined pressure to which air is compressed within the receiving tank, as well as the depth to which the wall of air bubbles extend, and the duration of air bubble expulsion, may be varied depending on the type of fishing vessel as well as the size and type of net being utilized.

All such variations and modifications are believed to be within the sphere and scope of the invention as defined in the claims appended hereto.

We claim:

1. In a fishing vessel having a keel, and provided with a net which is cast into surrounding water for catching fish, a method for repelling fish into said net, comprising expelling a substantially vertical wall of bubbles from said keel downwardly into said surrounding water, whereby fish swimming between said net and said wall of bubbles are startled and thereby repelled from said wall of bubbles into said net.

2. A method as defined in claim 1, further comprising the steps of receiving and compressing intake air to a predetermined pressure, expelling said compressed air in the form of a high pressure air flow, mixing water with said high pressure air flow, and releasing said mixed water and air via a plurality of nozzles disposed in said keel into said surrounding water, thereby creating said substantially vertical wall of bubbles.

3. A method as defined in claim 2, further comprising the step of selectively enabling and disabling predetermined ones of said nozzles, thereby controlling the shape of said wall of bubbles.

4. In a fishing vessel floating in water and being provided with a keel and a net which is cast into said water for catching fish, a pneumatic plunger system for repelling fish into said net comprised of:

(a) air compressor means for receiving and compressing intake air to a predetermined pressure, (b) a plurality of nozzles disposed in said keel and connected to said air compressor means, and (c) means for discharging said compressed intake air from said air compressor means in the form of one or more high pressure air flows through said nozzles, whereby a substantially vertical wall of bubbles is developed in said water beneath said keel such that fish swimming between said net and said wall of bubbles are startled and thereby repelled from said wall of bubbles into said net.

5. A pneumatic plunger system as defined in claim 4, further comprising means for selectively enabling and disabling predetermined ones of said nozzles, whereby the shape of said wall of bubbles is controlled.

6. A pneumatic plunger system as defined in claim 5, further comprising an exhaust line for conveying said compressed intake air from said air compressor means to said plurality of nozzles.

7. A pneumatic plunger system as defined in claim 6, further comprised of means for receiving and mixing water with said compressed air in said exhaust line.

8. A pneumatic plunger system as defined in claim 7, wherein said means for receiving and mixing water is comprised of a water pump having an inlet disposed in said water, for receiving and pumping said water into said exhaust line.

9. A pneumatic plunger system as defined in claim 4, further comprising suction means for drawing said intake air into said air compressor means.

10. A pneumatic plunger system as defined in claim 4 wherein said air compressor means is further comprised of a suction device for receiving said intake air, a receiving tank for holding said intake air, and an air compressor for drawing said intake air through said suction device and compressing said intake air into said receiving tank.

11. A pneumatic plunger system as defined in claim 4, further comprising a plurality of unidirectional check valves connected to respective ones of said nozzles, for regulating said one or more high pressure air flows.

12. A pneumatic plunger system as defined in claim 4, further comprising a plurality of solenoids connected to respective ones of said nozzles, and a remote control unit for selectively enabling said solenoids, such that said one or more high pressure air flows pass therethrough and are expelled from said nozzles.

* * * * *